United States Patent [19]

Green et al.

[11] 4,166,090

[45] Aug. 28, 1979

[54] FIBROUS MATERIAL MOULDING APPARATUS

[75] Inventors: Kieron P. Green, Thame; Bruce R. Inglis, High Wycombe; Roger A. Allen, Great Missenden; Roger W. Tringham, Beaconsfield, all of England

[73] Assignee: Wiggins Teape Limited, Hampshire, England

[21] Appl. No.: 820,388

[22] Filed: Jul. 29, 1977

[30] Foreign Application Priority Data

Aug. 2, 1976 [GB] United Kingdom ..... 32180/76

[51] Int. Cl.[2] ..... B28B 1/26

[52] U.S. Cl. ..... 264/25; 264/87; 264/510; 264/113; 264/518

[58] Field of Search ..... 264/113, 121, 91, 87, 264/25

[56] References Cited

U.S. PATENT DOCUMENTS

| | | | |
|---|---|---|---|
| 3,377,220 | 4/1968 | Berger et al. | 264/121 |
| 3,819,435 | 6/1974 | Roberts | 264/121 |
| 3,882,211 | 5/1975 | Kamp | 264/91 |

*Primary Examiner*—Robert F. White
*Assistant Examiner*—James R. Hall
*Attorney, Agent, or Firm*—Imirie, Smiley & Guay

[57] ABSTRACT

A process for continuously forming a fibrous element in an elongate closed foraminous former during movement of the former through fluid extraction means, and which includes the steps of forming a fibrous dispersion, injecting the dispersion into said former, generating a pressure gradient across an extraction zone within said fluid extraction means and injecting the fibrous dispersion into the former at an injection velocity relative to the speed of the former (efflux ratio) to cause some of the fibres to build up as a fibrous mat on the inner surface of the former and the remainder to pack together to form a core so as to produce a continuous fibrous element having a fibrous core which is enclosed by a crust of greater density.

16 Claims, 15 Drawing Figures

Figures 1, 2:
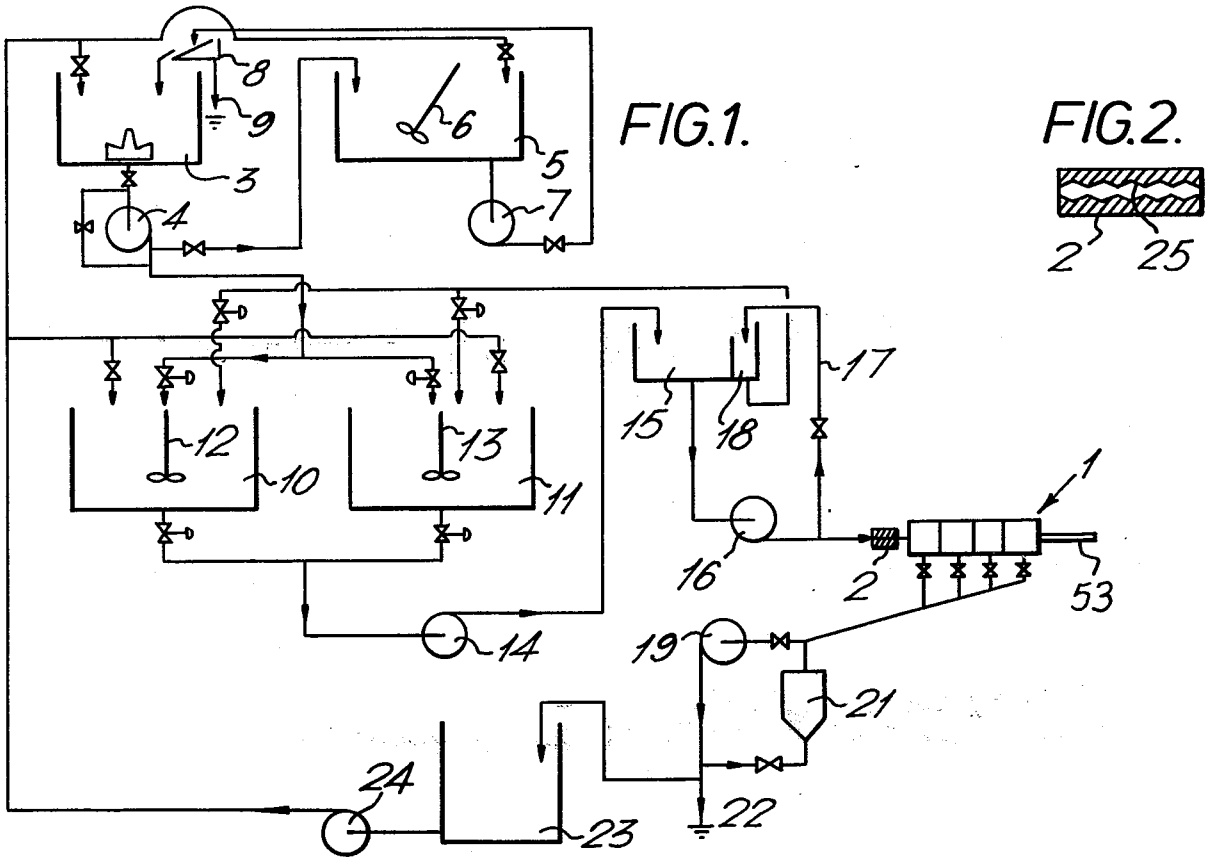

1
2
3
4
5
6
7
8
9
10
11
12
13
14
15
16
17
18
19
21
22
23
24
25
53

FIBROUS MATERIAL MOULDING APPARATUS

This invention relates to an improved process and apparatus for manufacturing elongated fibrous elements, and is concerned particularly but not exclusively with the manufacture of fibrous rods from which cigarette filter elements can be formed.

The cigarette industry predominately uses smoking product filters of two basic kinds, namely cellulose acetate, crimped paper, and also a third kind consisting of a composite of the first two. All three kinds of filter require paper wrapping to maintain their cylindrical form, or suffer from other disadvantages which are set out in greater detail in copending British Patent Application No. 32179/76, which is directed to an improved smoking product filter.

It is among the objects of the present invention to provide a process for forming an elongate fibrous element, which in a cylindrical form is suitable for use as a cigarette filter, and which has substantial structural integrity, obviating the necessity for paper wrapping. It has now been found possible by using a modification of the conventional Fourdrinier papermaking procedures to form such a product, which, subsequent to the initial forming process, requires no processing beyond drying and cutting to length before incorporation in a filter cigarette.

In conventional papermaking procedures using the Fourdrinier process, a dispersion is first prepared of paper making fibres, for example wood pulp fibres. This dispersion, which has a relatively low consistency of in the region of 0.5%, constitutes the papermaking stock which is projected from the slice of the paper machine headbox and deposited across the width of a moving Fourdrinier wire. A substantial proportion of the water content of the dispersion is removed on the wire, in part by direct drainage assisted by foils, and in part by the application of vacuum. Hydrogen bonds are formed between the residual fibres to form a web, which is then lifted from the wire and passed to the press and dryer sections of the paper machine.

In the Fourdrinier process, the efflux ratio (that is the ratio of the rate of deposition of the stock from the slice to the rate of movement of the Fourdrinier wire) is carefully controlled. In most cases it is in the region of 1:1 and even in specialised systems is unlikely to exceed 2:1. Too great a departure from the 1:1 ratio leads to poor paper formation and to a tendency for the fibres to orient in a manner which leads to a loss of strength.

The use of a modified Fourdrinier type machine for the production of cigarette filters has already been proposed in United Kingdom patent specification No. 748,095. A cigarette filter which it is proposed can be made with such a machine is also disclosed in United Kingdom patent specification No. 753,203.

Specification No. 748,095 discloses a machine in which one or more foraminous belts or similar elements are guided in co-operation to define a tubular forming zone. Moisturized cellulose fibre pulp is fed into the forming zone while the belts are in movement and water is removed from the pulp through the belts partly by simple drainage and partly by the application of vacuum.

The resultant fibrous structure issuing from the forming zone is variable in density and not sufficiently compact to be self supporting, and further processing is required to improve its compaction, in particular consolidation by the application of pressure.

Specification No. 753,203 accordingly proposes the use of a number of surface treatments, including paper wrapping, to provide the filter formed by the process of specification No. 748,095, with sufficient structural integrity for it to be usable in high speed cigarette manufacturing machinery.

The need for compaction and surface treatment of the prior art product is believed to stem from the lack of cohesion between the fibres of the fibrous mass constituting the product as it leaves from the forming zone. This lack of cohesion would appear to result primarily from an incorrect choice of stock consistency and the use of too low an efflux ratio. Failure to exclude free air from the stock and the apparatus with which the process is carried out can also lead to unacceptable variations in product density.

It is among the objects of the present invention to provide an improved process whereby sufficient structural integrity can be conferred on the product to obviate the necessity for subsequent compaction or surface treatments such as wrapping.

According to the present invention, a process for continuously forming a fibrous element, in an elongate closed foraminous former during movement of the former through fluid extraction means, includes the steps of forming a fibrous dispersion, injecting the dispersion into said former generating a pressure gradient across an extraction zone within said fluid extraction means and injecting the fibrous dispersion into the former at an injection velocity relative to the speed of the former (efflux ratio) to cause some of the fibres to build up as a fibrous mat on the inner surface of the former and the remainder to pack together to form a core so as to produce a continuous fibrous element having a fibrous core which is enclosed by a crust of greater density.

A further manufacturing operation or treatment is preferably applied to the element subsequent to forming, such as drying, but without applying or causing to be applied any bending or compressing forces thereto which affect the structural integrity of the crust, thus the element may be arranged to travel in a linear direction without bending to a dryer which causes air to be drawn into and then sucked out of it and/or it can be cut into lengths prior to being moved laterally for delivery to a radio frequency dryer.

Density variations in the product can be minimized by excluding free air from the fluid extraction zone, and by ensuring that flocculation of the dispersion is prevented, first by promoting turbulence in the dispersion immediately prior to injection, and secondly by maintaining the consistency at an optimum level relative to the particular injection velocity used.

It has been found that the maximum consistency of the dispersion used will vary both with the injection velocity and with the fibre type, but that a satisfactory element cannot be formed with consistencies in excess of about 3%.

Similarly, it has been found that the ratio of the injection velocity to the speed of the forming means (the efflux ratio) has a minimum value dependent upon the type of fibre used, but that even with the shortest fibres a satisfactory product cannot be formed at an efflux ratio of less than about 5:1. For high alpha cellulose softwood fibres such as are proposed for use herein for the manufacture of cigarette filters, the minimum efflux ratio is in the region of 10:1.

It has been found that use of the process of the invention results in an element having a surface layer substantially denser than its core and that this surface layer or casing confers a hardness on the product which, when in the form of a cigarette filter, is comparable with that of cellulose acetate filters. By selecting a mesh of appropriate size and weave for the material of the foraminous belts, which are preferably of a plastics material such as nylon, an acceptable surface smoothness is also achieved. As a result, the product leaving the forming zone can, after drying and cutting, be fed directly to cigarette manufacturing machinery for incorporation in cigarettes without any intermediate treatment or wrapping operation being required.

Figures 3, 4, 5, 6, 7:
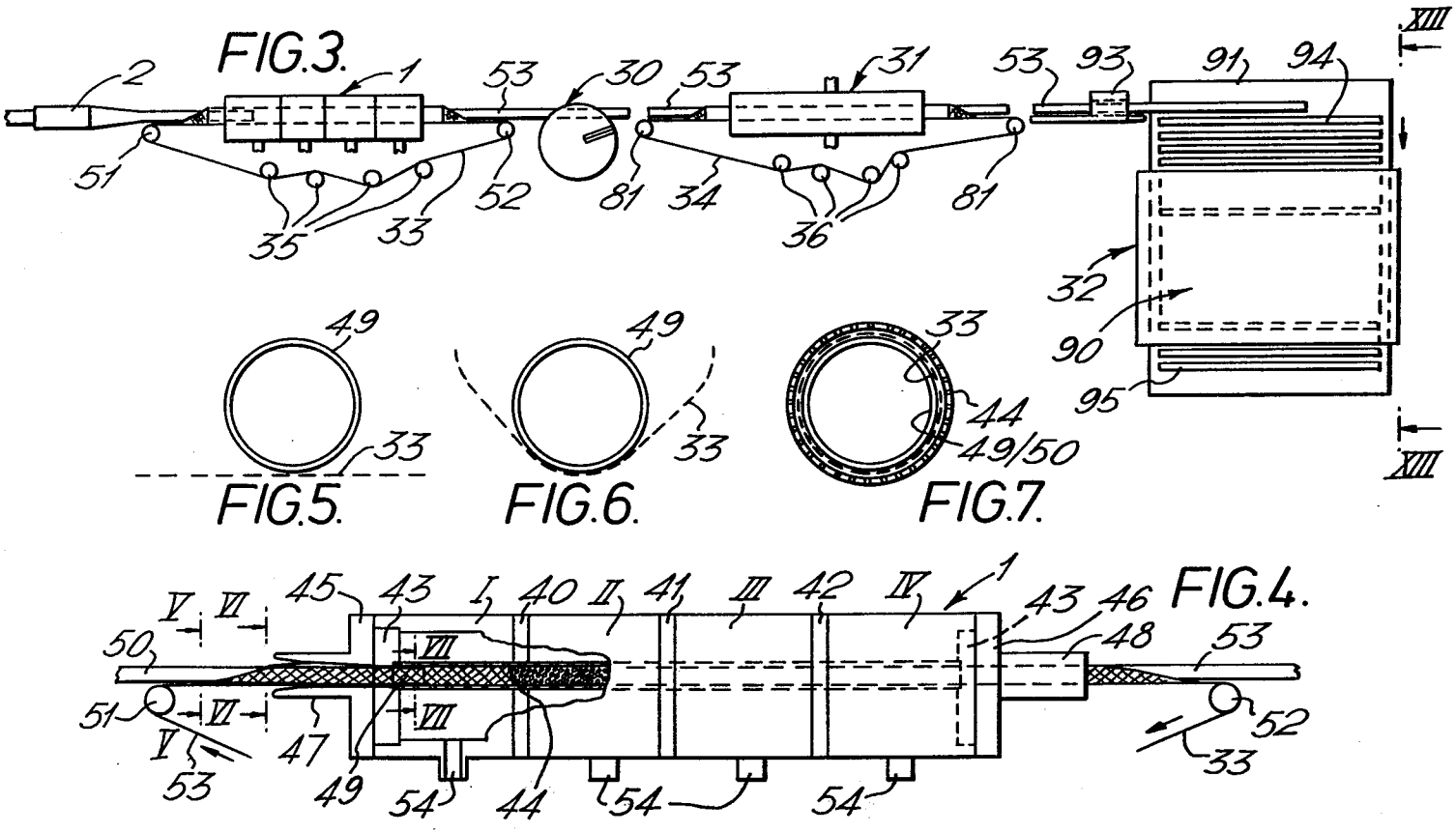
Figure 8:
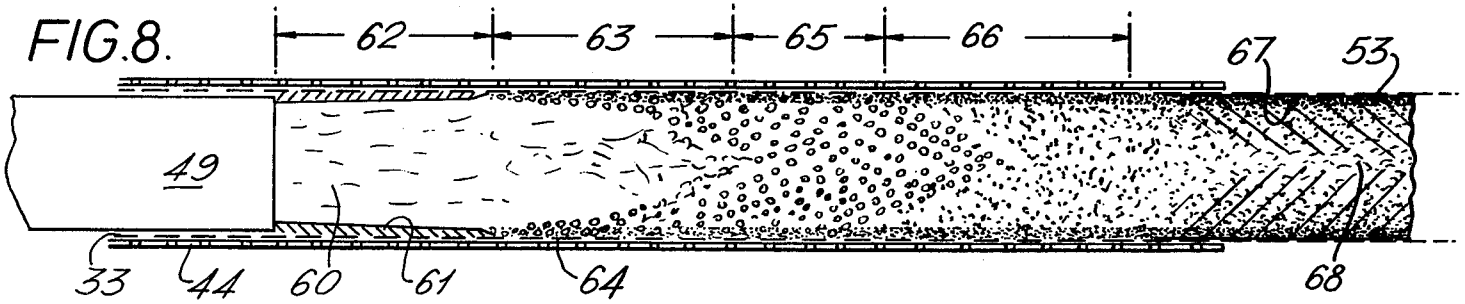
Figure 10:
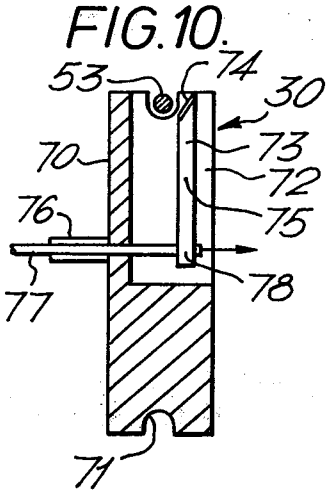
Figure 9:
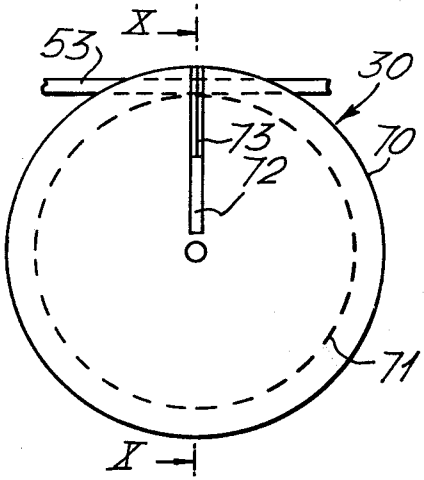
Figure 13:
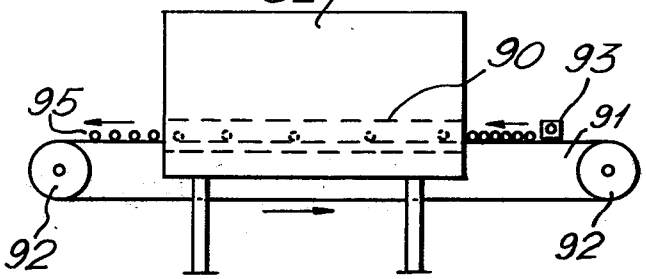
Figure 11:
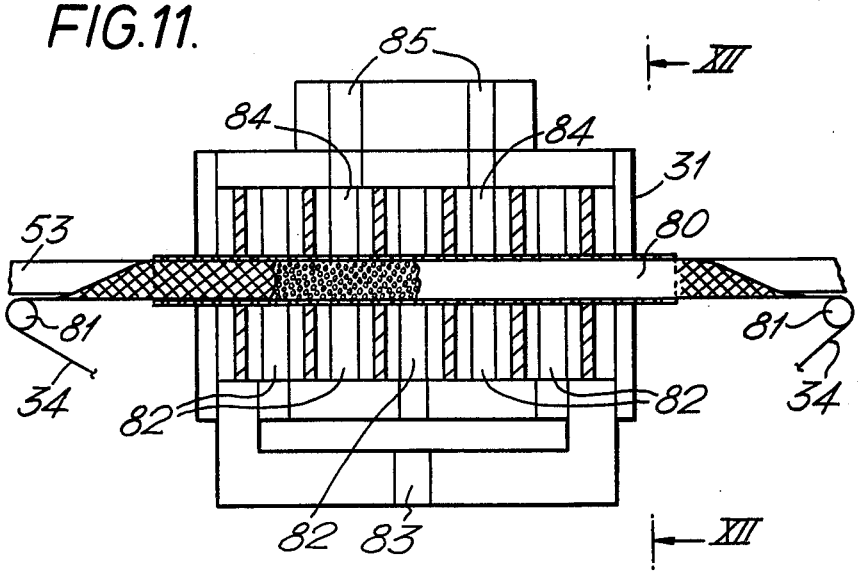
Figure 12:
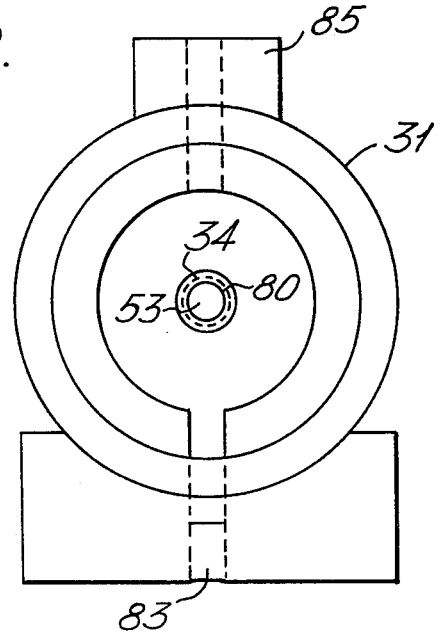
Figure 14:
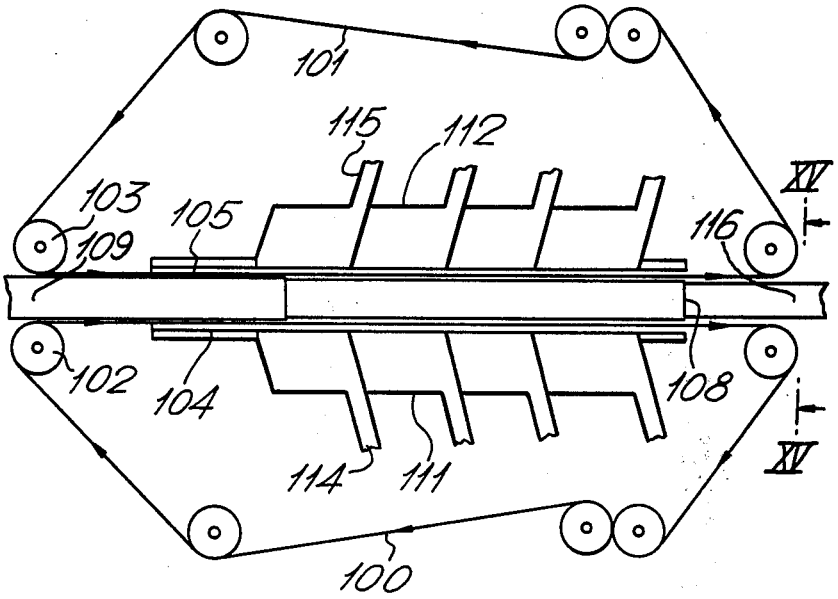
Figure 15:
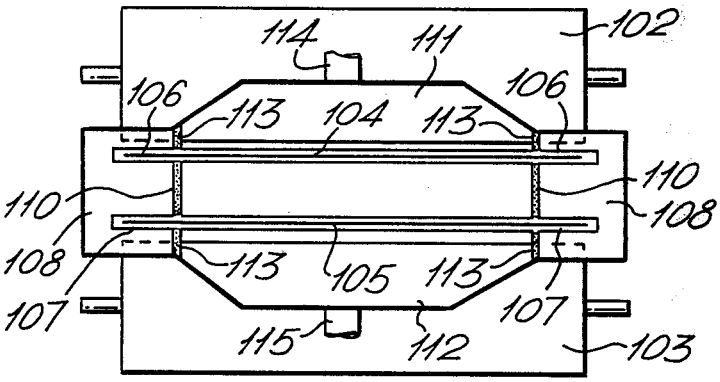

The invention will now be further described with reference to the accompanying drawings in which:

FIG. 1 is a semi-diagrammatic block diagram of a former according to the invention in association with a suitable stock preparation system, FIG. 2 is a sectional elevation of a component of the system shown in FIG. 1, FIG. 3 is a semi-diagrammatic lay-out showing a former according to the invention and other components for forming a dried rod product, FIG. 4 is a side elevation, partly in section, showing in greater detail a former according to the invention, FIG. 5 is an end section on the lines V—V of FIG. 4, FIG. 6 is an end section on the lines VI—VI of FIG. 4, FIG. 7 is an end section on the lines VII—VII of FIG. 4, FIG. 8 is a diagrammatic longitudinal sectional elevation of a former according to the invention showing the process whereby the product is formed in the forming zone, FIG. 9 is a side elevation of another component of the assembly shown in FIG. 3, FIG. 10 is a sectional elevation on the lines X—X of FIG. 9, FIG. 11 is a longitudinal sectional elevation of another component shown in FIG. 3, FIG. 12 is an end elevation on the lines XII—XII of FIG. 11, FIG. 13 is an elevation on the lines XIII—XIII of FIG. 3, FIG. 14 is a semi-diagrammatic sectional side elevation of part of a machine for forming a flat board-like product according to the process of the invention; and FIG. 15 is a sectional elevation on the lines XV—XV of FIG. 14.

Referring first to FIG. 1, this shows a fibrous element forming unit 1 fed with a fibrous dispersion through a turbulence generating unit 2. The element forming unit 1 and turbulence generating unit 2 are described in detail below.

Stock is prepared and fed to the turbulence generating unit 2 as follows. A suitable fibrous pulp is first slushed in a pulper 3 and fed by means of a pump 4 to a dilution tank 5 in which an agitator 6 is located. The pulp is diluted to a consistency of about 1% in the tank 5 and is recycled by means of a pump 7 through a classifier 8 into the pulper 3. Fines removed from the stock in the classifier 8 are discharged at 9.

Diluted and classified stock is then fed by means of the pump 4 to the thin stock tanks 10 and 11 in which agitators 12 and 13 are located. Thin stock from the tanks 10 and 11 is fed via a pump 14 to a constant head tank 15 supplying a pump 16. The outlet of the pump 16 supplies the turbulence generating unit 2 and a recycling line 17 returning stock to the constant head tank 15 and the recycling line 17 prevent pressure and therefore speed variations in the stock flowing to the turbulence generating unit 2. The constant head tank 15 can be replaced by a Deculator unit (not shown). This comprises a closed tank into which the stock is sprayed, the tank being subjected to vacuum, so that the stock passing from the Deculator unit to turbulence generating unit 2 and then to element forming unit 1 is deaerated.

In the element forming unit 1, water is removed from the stock by means of vacuum pump 19, so that a rod-like element 53 is formed. The process of formation is described in greater detail below. The vacuum pump 19 has a ballast tank 21 fitted in a recycling circuit therewith and discharges, either to waste at 22, or to a return tank 23. A pump 24 returns the extracted water to the dilution tank 5.

The internal configuration of the turbulence generating unit 2 is best seen in FIG. 2. The unit 2 is formed with a number of internal corrugations 25 which generate eddies and produce turbulence in the stock, thus preventing flocculation before the stock is injected into the element forming unit 1.

Turning now to FIG. 3, the assembly of components thereshown consists of the element forming unit 1, a rotary cutter unit 30 for cutting the element into predetermined lengths, a dry box 31, and a radio frequency drier 32. The dry box 31 and drier 32 serve respectively to reduce the water content of the product and to dry it to a final moisture content of about 10%.

The element forming unit 1 and the dry box 31 are each formed internally with perforated tubes 44 (see FIGS. 4 and 7) which are described in greater detail below, which serve to conform Fourdrinier wires 33 and 34 respectively into a generally cylindrical form 33 (see FIGS. 5 to 7) when passing through element forming unit 1 and dry box 31, respectively. The Fourdrinier wires are preferably formed of plastics materials such as nylon, and passed around tensioning rolls 35 and 36 respectively.

The element forming unit 1 is shown in greater detail in FIGS. 4 and 7 and consists of fluid extraction means provided by drainage casings I, II, III and IV defined by walls 40, 41 and 42, 43. A perforated tube 44 which acts as a foraminous forming chamber passes through all the casings terminating in walls 43. End plates 45 and 46 are secured to the walls 43 and carry inlet and outlet guide tubes 47 and 48 coaxial with the perforated tube 44. A stock injection nozzle 49 formed by the end of an inlet guide 50 projects through the inlet guide tube 47 into the perforated tube 44. The nylon Fourdrinier wire 33 acts as an elongate foraminous former after passing around roller 51 in a flat condition and being progressively formed into a cylindrical configuration while passing through the inlet guide tube 47 and perforated tube 44 as seen in FIGS. 5, 6 and 7. The perforated tube 44, the injection nozzle 49 and the Fourdrinier wire 33 are so dimensioned that a tight sliding fit is achieved between these components, whereby the ingress of air is effectively prevented around its interface with the walls of the Fourdrinier wire 33 and through the inlet guide tube 47. Having passed outwardly through outlet guide tube 48, the Fourdrinier wire 33 relaxes into a flat condition as it is drawn around roller 52 while the rod-like element 53 which has been formed continues to move axially in alignment with the tube 44.

Each of the casings I, II, III and IV which it will be seen are in tandem configuration is provided with an extraction port 54 for the application of vacuum and the withdrawal of water drained from the stock through the Fourdrinier wire 33 and perforated tube 44, so that a fluid extraction zone is provided within the drainage casings.

Operation of elements forming unit 1 in producing the rod-like element 53 is best understood with reference to FIG. 8 which is an enlarged view of the perforated tube 44, the inlet nozzle 49 and the Fourdrinier wire 33. Provided that the fibrous dispersion is injected through the injection nozzle 49 at a suitable consistency and at an appropriate speed relative to the speed of the Fourdrinier wire 33, the forming process shown in FIG. 8 occurs. The fibrous stock 60 entering the former provided by the Fourdrinier wire 33 has a boundary layer 61 which rapidly drains in the first part of the fluid extract zone provided by first drainage zone 62. In a second drainage zone 63, a fibre mat begins to form on the surface of the Fourdrinier wire 33, as at 64. However, because of the high velocity of the stock relative to the wire 33, the fibre mat is disrupted into small flocs which break loose and are driven forward into a thickening zone 65.

The stock velocity reduces progressively along the thickening zone as water drains from the chamber through the Fourdrinier wire 33 and perforated tube 44, until disruption of the fibrous mat no longer occurs. To flocs then build up very quickly and fill the core in a final formation zone 66. Because the mat forms initially on the Fourdrinier wire 33 and builds up progressively towards the centre, a generally conical layering effect occurs. As flocs are driven into the conically concave rear end face of the rod being formed, pressure re-generation occurs, which assists both in compacting the fibrous structure and also in driving out a proportion of the residual water. The final formation zone at the end of the fluid extraction zone is analogous to the dry line on a paper-forming machine Fourdrinier wire.

The tightly packed fibres of the fibrous crust forming the residue of the fibre mat reduces the rate of drainage through the Fourdrinier wire 33 and tube 44 as the wire passes through thickening zone 65 and final 66. As a result, the fibre crust 67 is of greater density than the core 68 of the rod-like elements 53, via., the product as it leaves the element forming unit 1.

It is convenient to cut the rod-like element 53 into convenient lengths for further processing immediately after it has left the element forming unit 1 and this is achieved by means of a rotary cutter unit 30 which is described in greater detail in FIGS. 9 and 10. The rotary cutter unit 30 consists of a rotor 70 having an annular U-section groove 71 in its periphery which supports rod-like element 53 tangentially at the "12 o'clock" position. Within a radial slot 72 in rotor knife bar 73, having a cutting edge 74, is pivoted at 75. The rotor 70 is mounted on a hollow shaft 76 which is journalled for rotation in bearings not shown in the drawings. A knife activating rod 77 extends through the hollow shaft 76 and is pivoted to the rotor knife bar 73 at 78. The activating rod 77 is controlled by a suitable comming mechanism, not shown so as to activate the rotor knife bar 73 when it is at the "12 o'clock" position shown in FIG. 9. This causes the knife to rock about the pivot 75 and cut the rod-like element 53 with the knife edge 74.

The moisture content of the rod-like element 53 as formed is normally between 75% and 85% by weight, but this can be further reduced by the use of a dry box 31 which is shown in greater detail in FIGS. 11 and 12. The rod-like element 53 is carried through a perforated tube 80 by means of the Fourdrinier wire 34 passing around rollers 81. The perforated tube 80 extends through a series of chambers 82 which are subjected to vacuum through a manifold 83. Alternating with the vacuum chambers 82 are chambers 84 which are open to atmosphere through a manifold 85. During movement of the rod-like element 53 through the perforated tube 80, air is drawn in through the manifold 85 and laterally into and along the rod. Water is thus drawn outwardly from the rod-like element 53 through the chambers 82 and the manifold 83.

FIG. 13 shows a radio frequency drier 32 formed with a tunnel 90 through which the upper run of an endless conveyor belt 91 passes, the belt being supported at each end of its run on drums 92. The conveyor belt 91 is made of a material, for example a woven nylon mesh, which is not susceptible to heating in a radio frequency field. Cut lengths of the rod-like element 53 received from the dry box 31 are supported and guided onto the conveyor belt 91 by means of a support and guide unit 93 (see also FIG. 3). The cut lengths 94 (also in FIG. 3) then pass through the tunnel 90 of the radio frequency drier and emerge at 95 with a moisture content of about 10%. In this condition, they are suitable for further reduction into lengths which can be conveniently handled by cigarette manufacturing machinery.

Referring again to FIG. 3, it will be appreciated that the Fourdrinier wire belt 34 is operated at a speed slightly greater than the Fourdrinier wire belt 33 so that, after the rod-like element 53 has been cut by the rotary cutter unit 30, the cut lengths are spaced apart a slight amount before entering the support and guide unit 93. In this way, each cut length can be deposited on the conveyor belt 91 in time for it to effect lateral movement before the leading end of the next length is delivered onto the conveyor. Moreover the uses of lateral movement within the dryer enables the length of the apparatus to be reduced and for elements to be made fast enough for delivery from the dryer direct to a cigarette making machine.

It will be seen that delivery to the dry box 31 is a linear movement from the end of element forming unit 1 so that no bending or compressing forces are applied to the freshly formed element which might affect the structural integrity of the crust prior to its being dried and ready for use. Similarly the element is only moved sideways into the radio frequency 32 after it has been cut so that again no bending or compressive forces are applied to the newly formed crust.

The following table relates to 32 examples of the production of fibre rods suitable for use as cigarette filters:

TABLE

| | PART 1 | | | | | | | | |
|---|---|---|---|---|---|---|---|---|---|
| EXAMPLE | 1 | 2 | 3 | 4 | 5 | 6 | 7 | 8 | 9 |
| PULP FURNISH | 100% BLEACHED SOFTWOOD SULPHATE (STORA 32) | | | | 100% BLEACHED SOFTWOOD SULPHITE (WEYERHAUSER AA) | | | | |
| STOCK CONSISTENCY % | 3.48 | 2.95 | 2.21 | 1.89 | 1.67 | 1.67 | 1.17 | 0.65 | 0.42 |

TABLE-continued

| | | | | | | | | | |
|---|---|---|---|---|---|---|---|---|---|
| STOCK PRESSURE Kilopascals | 71.1 | 69.0 | 48.3 | 48.3 | 20.7 | 48.9 | 1.72 | 10.5 | 41.4 |
| INJECTION NOZZLE INTERNAL DIAMETER (mm) | 7.0 | 7.0 | 7.0 | 7.0 | 6.5 | 6.5 | 6.0 | 6.0 | 6.5 |
| STOCK VELOCITY meters/min (x) | 62.29 | 79.73 | 103.0 | 115.5 | 78.0 | 240.0 | 984.0 | 552.2 | 534.0 |
| WIRE FORMER SPEED meters/min (y) | 10.6 | 10.5 | 10.8 | 10.8 | 5.0 | 15.0 | 40.0 | 15.6 | 10.0 |
| EFFLUX RATIO (x/y) | 5.88 | 7.59 | 9.54 | 10.70 | 15.6 | 16.0 | 24.6 | 35.4 | 53.4 |
| APPROXIMATE DRAINAGE LENGTH (mm) | 50 | 50 | 50 | 100 | 118 | 180 | 400 | 180 | 160 |
| FORMER VACUUM-CHAMBER I (mm-Hg) | 76.2 | 76.2 | 88.9 | 88.9 | 229 | 241 | 432 | 203 | 102 |
| FORMER VACUUM-CHAMBER II (mm-Hg) | 165.1 | 152.4 | 165.1 | 165.1 | 241 | 292 | 406 | 140 | 178 |
| FORMER VACUUM-CHAMBER III (mm-Hg) | 101.6 | 101.6 | 101.6 | 101.6 | 229 | 267 | 406 | 102 | 178 |
| FORMER VACUUM-CHAMBER IV (mm-Hg) | 139.7 | 152.4 | 139.7 | 139.7 | 267 | 318 | 381 | 76 | 203 |
| % OPEN AREA FORMING TUBE | 38.6 | 38.6 | 38.6 | 38.6 | 38.6 | 38.6 | 38.6 | 38.6 | 38.6 |
| ROD WEIGHT (grams/meter) | 7.87 | 8.62 | 8.11 | 7.78 | 8.72 | 8.94 | 8.74 | 6.61 | 7.44 |
| ROD DIAMETER (mm) | 7.52 | 7.57 | 7.50 | 7.40 | 7.78 | 7.80 | 7.75 | 7.21 | 7.49 |

PART 2

| EXAMPLE | 10 | 11 | 12 | 13 | 14 |
|---|---|---|---|---|---|
| PULP FURNISH | 70% BLEACHED SOFTWOOD SULPHATE 30% SYNTHETIC WOOD | 100% BLEACHED SOFTWOOD SULPHITE | 100% BLEACHED SOFTWOOD SULPHATE (BUCKEYE PV5) | | |
| STOCK CONSISTENCY % | 0.25 | 0.2 | 0.15 | 1.2 | 1.1 |
| STOCK PRESSURE Kilopascals | 34.5 | 27.9 | 27.9 | 79.3 | 55.2 |
| INJECTION NOZZLE INTERNAL DIAMETER (mm) | 6.5 | 6.5 | 6.5 | 7.0 | 7.0 |
| STOCK VELOCITY meters/min (x) | 69.8 | 88.8 | 132.5 | 496.1 | 192.7 |
| WIRE FORMER SPEED meters/min (y) | 6.1 | 5.2 | 2.4 | 30.0 | 10.0 |
| EFFLUX RATIO (x/y) | 69.8 | 88.8 | 132.5 | 16.54 | 19.27 |
| APPROXIMATE DRAINAGE LENGTH (mm) | 60 | 180 | 160 | 80 | 60 |
| FORMER VACUUM-CHAMBER I (mm-Hg) | 127 | 127 | 51 | 88.9 | 190.5 |
| FORMER VACUUM-CHAMBER II (mm-Hg) | 102 | 102 | 51 | 254.0 | 254.0 |
| FORMER VACUUM-CHAMBER III (mm-Hg) | 76 | 127 | 76 | 190.5 | 190.5 |
| FORMER VACUUM-CHAMBER IV (mm-Hg) | 76 | 152 | 76 | 241.3 | 254.0 |
| % OPEN AREA FORMING TUBE | 38.6 | 38.6 | 38.6 | 38.6 | 38.6 |
| ROD WEIGHT (grams/meter) | 5.76 | 5.88 | 6.6 | 7.64 | 8.16 |
| ROD DIAMETER (mm) | 7.45 | 7.66 | 7.76 | 7.76 | 8.07 |

PART 3

| EXAMPLE | 15 | 16 | 17 | 18 | 19 | 20 | 21 | 22 |
|---|---|---|---|---|---|---|---|---|
| PULP FURNISH | 100% BLEACHED SOFTWOOD SULPHATE (BUCKEYE PV5) | | | | | | | |
| STOCK CONSISTENCY % | 1.2 | 1.2 | 0.9 | 0.8 | 0.8 | 0.8 | 0.6 | 0.6 |
| STOCK PRESSURE Kilopascals | 62.1 | 79.3 | 50.0 | 58.6 | 117.2 | 48.3 | 103.4 | 189.6 |
| INJECTION NOZZLE | | | | | | | | |

TABLE-continued

| | | | | | | | | |
|---|---|---|---|---|---|---|---|---|
| INTERNAL DIAMETER (mm) | 7.0 | 7.0 | 7.0 | 7.0 | 7.0 | 7.0 | 7.0 | 7.0 |
| STOCK VELOCITY meters/min (x) | 340.7 | 511.7 | 225.1 | 471.4 | 711.0 | 257.5 | 619.9 | 976.6 |
| WIRE FORMER SPEED meters/min (y) | 20.0 | 30.0 | 10.0 | 20.0 | 30.0 | 10.0 | 20.0 | 30.0 |
| EFFLUX RATIO (x/y) | 17.0 | 17.1 | 22.5 | 23.6 | 23.7 | 25.8 | 31.0 | 29.3 |
| APPROXIMATE DRAINAGE LENGTH (mm) | 60 | 150 | 60 | 60 | 150 | 60 | 230 | 250 |
| FORMER VACUUM-CHAMBER I (mm-Hg) | 127.0 | 101.6 | 165.1 | 152.4 | 254.0 | 152.4 | 228.6 | 279.4 |
| FORMER VACUUM-CHAMBER II (mm-Hg) | 292.1 | 304.8 | 279.4 | 279.4 | 165.1 | 266.7 | 139.7 | 241.3 |
| FORMER VACUUM-CHAMBER III (mm-Hg) | 241.3 | 254.0 | 228.6 | 241.3 | 177.8 | 228.6 | 215.9 | 0 |
| FORMER VACUUM-CHAMBER IV (mm-Hg) | 279.4 | 279.4 | 254.0 | 254.0 | 292.1 | 254.0 | 266.7 | 355.6 |
| % OPEN AREA FORMING TUBE | 38.6 | 38.6 | 38.6 | 38.6 | 38.6 | 38.6 | 38.6 | 38.6 |
| ROD WEIGHT (grams/meter) | 7.87 | 7.88 | 7.80 | 7.26 | 7.30 | 7.93 | 7.16 | 7.52 |
| ROD DIAMETER (mm) | 7.36 | 7.88 | 7.96 | 7.86 | 7.86 | 8.05 | 7.93 | 8.03 |

PART 4

| EXAMPLE | 23 | 24 | 25 | 26 | 27 | 28 | 29 |
|---|---|---|---|---|---|---|---|
| PULP FURNISH | 100% BLEACHED SOFTWOOD SULPHATE (BUCKEYE PV5) | | | | | 55% SOFTWOOD SULPHATE (BUCKEYE PV5) 45% ESPARTO | |
| STOCK CONSISTENCY % | 0.6 | 0.6 | 0.3 | 0.3 | 0.3 | 0.46 | 0.46 |
| STOCK PRESSURE Kilopascals | 48.3 | 82.7 | 75.3 | 137.9 | 117.2 | 69.0 | 17.2 |
| INJECTION NOZZLE INTERNAL DIAMETER (mm) | 7.0 | 7.0 | 7.0 | 7.0 | 7.0 | 7.0 | 7.0 |
| STOCK VELOCITY meters/min (x) | 331.6 | 637.2 | 613.0 | 1423.4 | 573.2 | 411.9 | 334.9 |
| WIRE FORMER SPEED meters/min (y) | 10.0 | 20.0 | 10.0 | 20.0 | 10.0 | 9.8 | 10.4 |
| EFFLUX RATIO (x/y) | 33.2 | 31.9 | 61.3 | 71.2 | 57.3 | 42.03 | 32.2 |
| APPROXIMATE DRAINAGE LENGTH (mm) | 60 | 230 | 230 | 480 | 230 | 130 | 160 |
| FORMER VACUUM-CHAMBER I (mm-Hg) | 101.6 | 241.3 | 215.9 | 279.4 | 228.6 | 127.0 | 101.6 |
| FORMER VACUUM-CHAMBER II (mm-Hg) | 215.9 | 165.1 | 165.1 | 215.9 | 152.4 | 76.2 | 76.2 |
| FORMER VACUUM-CHAMBER III (mm-Hg) | 165.1 | 101.6 | 101.6 | 0 | 76.2 | 127.0 | 101.6 |
| FORMER VACUUM-CHAMBER IV (mm-Hg) | 215.9 | 241.3 | 254.0 | 152.4 | 241.3 | 127.0 | 114.3 |
| % OPEN AREA FORMING TUBE | 38.6 | 38.6 | 38.6 | 38.6 | 38.6 | 38.6 | 38.6 |
| ROD WEIGHT (grams/meter) | 7.66 | 7.36 | 7.08 | 8.22 | 6.62 | 7.44 | 5.7 |
| ROD DIAMETER (mm) | 7.95 | 8.04 | 8.02 | 8.33 | 8.01 | 7.76 | 7.69 |

PART 5

| EXAMPLE | 30 | 31 | 32 |
|---|---|---|---|
| PULP FURNISH | 55% SOFTWOOD SULPHATE (BUCKEYE PV5) 45% EUCALYPTUS (CELBI) | | 90% BLEACHED SOFTWOOD SULPHATE (BUCKEYE PV5) 10% KAOLIN |
| STOCK CONSISTENCY % | 0.52 | 0.52 | 0.43 |
| STOCK PRESSURE Kilopascals | 82.7 | 27.6 | 48.7 |
| INJECTION NOZZLE INTERNAL DIAMETER (mm) | 7.0 | 7.0 | 7.0 |

TABLE-continued

| | | | |
|---|---|---|---|
| STOCK VELOCITY meters/min (x) | 438.3 | 323.7 | 494.4 |
| WIRE FORMER SPEED meters/min (y) | 9.8 | 9.8 | 10.0 |
| EFFLUX RATIO (x/Y) | 44.7 | 33.0 | 49.4 |
| APPROXIMATE DRAINAGE LENGTH (mm) | 160 | 160 | 130 |
| FORMER VACUUM-CHAMBER I (mm-Hg) | 13.8 | 24.1 | 13.8 |
| FORMER VACUUM-CHAMBER II (mm-Hg) | 41.4 | 139.7 | 76.2 |
| FORMER VACUUM-CHAMBER III (mm-Hg) | 127.0 | 31.0 | 76.2 |
| FORMER VACUUM-CHAMBER IV (mm-Hg) | 139.7 | 139.7 | 127.0 |
| % OPEN AREA FORMING TUBE | 38.0 | 38.6 | 38.6 |
| ROD WEIGHT (grams/meter) | 8.95 | 6.61 | 8.18 |
| ROD DIAMETER (mm) | 8.02 | 7.68 | 7.93 |

FIGS. 14 and 15 show a machine for making a board-like product. Two Fourdrinier wires 100 and 101 extending around press rolls 102 and 103 respectively have opposed runs 104 and 105 also respectively which, at their edges, extend in sealing slots 106 and 107 respectively of side member 108. An injection nozzle 109 extends between the opposed runs 104 and 105 so as to provide a sliding fit and prevent the ingress of air. At its sides, seals 110 are provided with the side members 108. Vacuum chambers 111 and 112 are positioned above and below the runs 104 and 105 respectively between the side members 108 and are sealed thereto as at 113. The vacuum chambers 111 and 112 have extract ducts 114 and 115 respectively.

In use, a well dispersed fibrous stock is injected into the space between the runs 104 and 105 of wire through the board injection nozzle 109 at a velocity at least 5 times that of the Fourdrinier wires 100 and 101, with the stock being at a consistency of not more than 3%. Vacuum extraction through the ducts 111 and 112 results in a board-like product 116 having surface layers which are denser than the core and which can be used for example as a filter material or for other purposes where it has application. It will be appreciated that the product has a substantially rectangular cross-section and similar apparatus could be used to produce an element of square cross section.

What we claim is:

1. A process for continuously forming a fibrous element in an elongate closed foraminous forming during movement of said former through fluid extraction means, said fibrous element comprising a fibrous core enclosed and stiffened by a fibrous crust which is integral with the core and has a density greater than that of the core, which comprises (a) forming an aqueous fibrous dispersion, (b) generating a pressure gradient across an extraction zone within said fluid extraction means, (c) continuously injecting the aqueous fibrous dispersion into the former at a predetermined efflux ratio, i.e., the ration of the aqueous fluid dispersion injection velocity relative to the speed of the moving former, to cause some of the fibres, upon extraction of fluid as the dispersion traverses said extraction zone, to build up as continuous crust on the inner surface of the former and the remaining fibres to pack together within the area inside said crust to form the aforesaid core so as to produce a continuous fibrous element, in said elongate, moving foraminous former, having a fibrous core enclosed and stiffened by a fibrous crust which is integral with the core but of greater density, and (d) removing said fibrous element thus formed from said former.

2. A process as claimed in claim 1 in which a further manufacturing operation is applied to the fibrous element subsequent to forming without applying or causing to be applied any bending or compressing forces thereto which affect the structural integrity of the crust, the further operation comprising (e) drying by causing air to be drawn into and then sucked out of the element.

3. A process as claimed in claim 2 which includes (d') cutting the element into predetermined lengths prior to carrying out operation (e).

4. A process as claimed in claim 3 in which step (e) is accomplished by employing a radio frequency dryer.

5. A process as claimed in claim 4 which comprises (f) causing the element to emerge from the forming process travelling in a linear direction and, upon cutting it into predetermined lengths, (g) moving it in a direction lateral to the linear direction for delivery to the radio frequency dryer.

6. A process as claimed in claim 1 which comprises (h) excluding intake of free air into the fibrous dispersion during its injection into the former and its passage through the fluid extraction means.

7. A process as claimed in claim 1 which comprises (i) preventing flocculation of the dispersion prior to injection into the foraminous former by promoting turbulence in the dispersion immediately prior to said injection into the former.

8. A process as claimed in claim 1 in which the consistency of the fibrous dispersion is not greater than 3%.

9. A process as claimed in claim 8 in which the ratio of injection velocity to the speed of the former (the efflux ratio) is at least 5 to 1.

10. A process as claimed in claim 9 in which the efflux ratio as defined in claim 9 is 10 to 1.

11. A process as claimed in claim 9 which comprises (j) de-aerating the fibrous dispersion prior to injection into the former.

12. A process as claimed in claim 11 in which de-aeration is achieved with a deculator unit.

13. A process as claimed in claim 1 in which the formed element is substantially circular in cross-section.

14. A process as claimed in claim 5 in which the formed element is rectangular or square in cross-section.

15. A process as claimed in claim 9 further comprising (k) controlling the fibrous dispersion consistency and efflux ratio to cause some of the fibres, upon extraction of fluid from the dispersion entering the extraction zone, to build up initially as a fibrous mat on the initial inner surface of the former entering the extraction zone, which mat, due to the efflux ratio, is partially disrupted into small flocs which break loose and pack together in a thickening zone as part of the core, the balance of the fibrous mat remaining to form the continuous crust enclosure of greater density than the core.

16. A process as claimed in claim 15 further comprising (1) controlling fibrous dispersion consistency and the efflux ratio such as to cause a generally conical layering effect in the core as fibres build up progressively toward the centre of the core.

* * * * *